United States Patent [19]

Sussman

[11] 3,978,192

[45] Aug. 31, 1976

[54] METHOD OF DRAWING FIBERS USING A MICROTERRACED DRAWING SURFACE

[76] Inventor: Martin V. Sussman, 1361 Massachusetts Avenue, Lexington, Mass. 02173

[22] Filed: July 1, 1974

[21] Appl. No.: 484,994

Related U.S. Application Data

[63] Continuation-in-part of Ser. No. 183,066, Sept. 23, 1971, abandoned, which is a continuation-in-part of Ser. No. 20,190, March 17, 1970, abandoned.

[52] U.S. Cl. ..... 264/290 N; 28/71.3; 264/290 T

[51] Int. Cl.[2] ..... B29C 17/02

[58] Field of Search ..... 264/290, 210 F, DIG. 73; 28/71.3

[56] References Cited

UNITED STATES PATENTS

| | | | |
|---|---|---|---|
| 2,174,688 | 10/1939 | Cotchett | 28/71.3 |
| 2,208,497 | 7/1940 | Coleshill et al. | 28/71.3 |
| 2,736,944 | 3/1956 | Herbert et al. | 28/71.3 |

*Primary Examiner*—Robert F. White
*Assistant Examiner*—James B. Lowe
*Attorney, Agent, or Firm*—Kenway & Jenney

[57] ABSTRACT

Method and apparatus for drawing an elongated synthetic resin member (e.g., fiber, filament, yarn, tow or tape) at high speed. The fiber, or other member, is caused to follow a multiplicity of turns between canted, spaced-apart bodies, at least one of which has a drawing surface defined by a continuously increasing radius. A microterraced drawing surface topography on the latter body facilitates compact construction of the equipment and yields improvements in operation. The number of draw stages and the draw ratio are adjustable; and it is possible to bulk the fiber during drawing. Chemical and other physical treatments may be incorporated with the drawing.

8 Claims, 21 Drawing Figures

FIG. 1
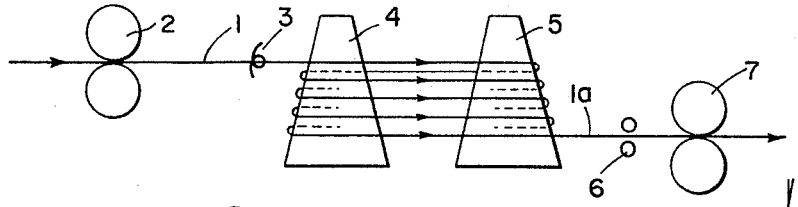
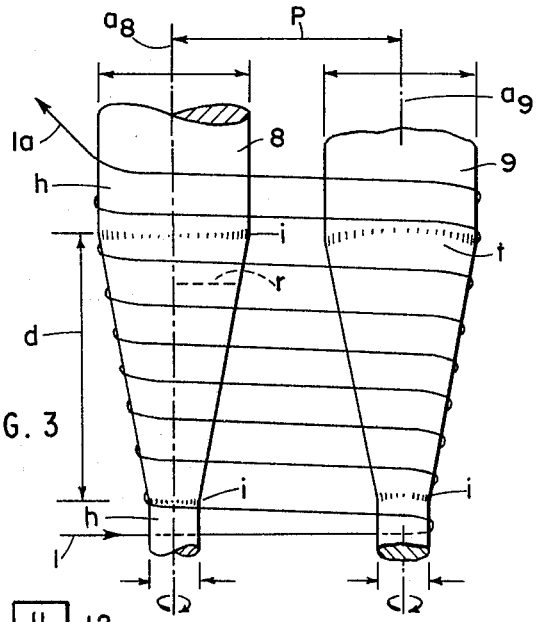
FIG. 3
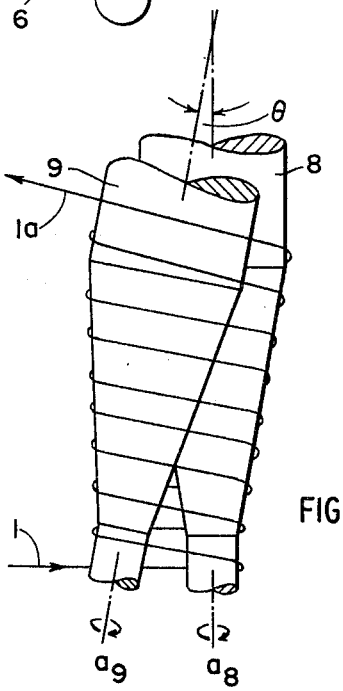
FIG. 2
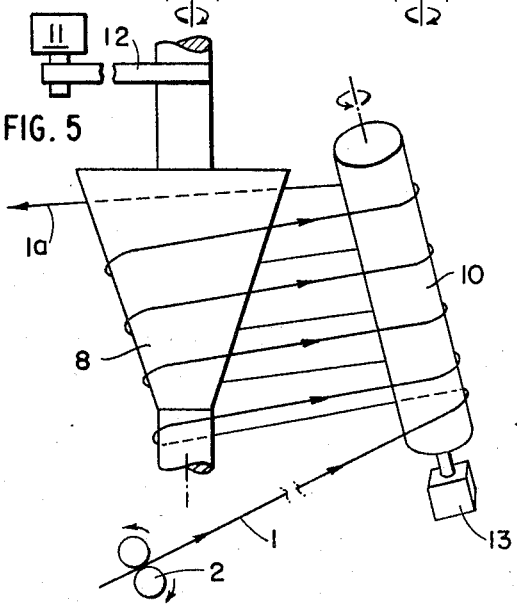
FIG. 5
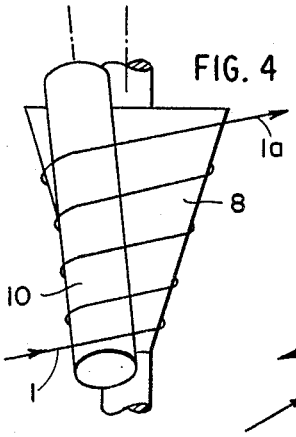
FIG. 4
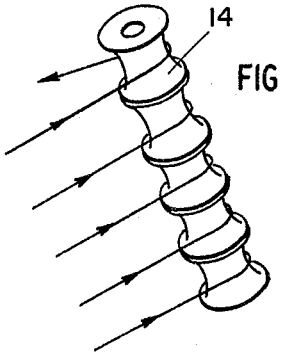
FIG. 6
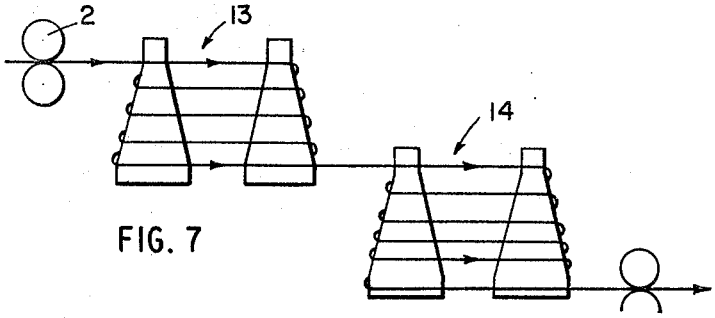
FIG. 7
INVENTOR
MARTIN V. SUSSMAN
BY Bruce A. Lepper
ATTORNEY

INVENTOR
MARTIN V. SUSSMAN

BY Bernie A. Leyner

ATTORNEY

INVENTOR
MARTIN V. SUSSMAN

BY Bernie A. Lepper

ATTORNEY

METHOD OF DRAWING FIBERS USING A MICROTERRACED DRAWING SURFACE

CROSS REFERENCE TO RELATED APPLICATIONS

This application is a continuation-in-part of my copending application Ser. No. 183,066 filed Sept. 23, 1971, which in turn is a continuation-in-part of my prior application Ser. No. 20,190 filed Mar. 17, 1970; both of which are now abandoned.

BACKGROUND

This invention relates to a method of drawing fibers, yarns, or relatively narrow plastic tapes and to apparatus for use in carrying out the method and more particularly to the drawing of synthetic fibers, yarns or narrow tapes. In the description of this invention which follows, for the sake of convenience, the method and apparatus will be described in terms of drawing fibers. However, it is to be understood that the method and apparatus are equally usable for drawing any elongated body subject to such procedure.

The term drawing is used herein with reference to the elongation of a fiber by between 200% and 2000% in a manner that increases the orientation of the fiber molecules in the longitudinal direction. The term should be distinguished from a lesser elongation, which is generally characterized as stretching.

In the production of most synthetic fibers and particularly those which are melt spun, such as nylon and polyester fibers, a drawing stage must be included subsequent to the spinning or extrusion stage in which the fibers are drawn or physically elongated to several times their original length. The drawing of the fibers is to enable them to achieve the required molecular orientation and structure by virtue of which they attain the necessary strength and other desired physical characteristics. This drawing has generally been hitherto effected on a commercial scale by passing the fiber from one to another set of rotating rollers, each set of rollers rotating at a surface speed which is greater than that of the preceding set. The ratio of the higher to the lower surface speeds determines the extent of fiber drawing. This ratio is called the "draw ratio" and a typical draw ratio for nylon fibers is about 4.8 to 1. With such conventional and known draw methods the fiber is subjected to a very abrupt acceleration and rise in tension at the point where it leaves one roller to pass to the succeeding higher speed roller and care must be taken to ensure that the abrupt rise in tension does not result in the breaking of the fiber. Thus with this conventional technique, which may be termed "inpulse drawing" because the fiber experiences a sudden inpulsive acceleration from its initial undrawn rate of travel through the draw machine to its final drawn rate of travel through the draw machine, an upper limit of draw speed exists beyond which danger of fiber breakage occurs because of the high fiber tensions that are imposed on the yarn during its "impulsive" acceleration. Furthermore, the drawing process must be carried out at surface speeds which are considerably less than the speed of fiber production by extrusion of melt spinning and in consequence the drawing stage may well be some twenty to 100 times slower than the extrusion or melt spinning stage. Therefore, the drawing of fibers constitutes a major factor in the slowing down of fiber production and contributes to production expense. Exemplary of method and apparatus designed to achieve all or at least a part of fiber elongation through such "impulse drawing" are described in U.S. Pat. Nos. 3,551,550 and 2,372,627. It would therefore be desirable to have an improved method and apparatus for drawing fibers, yarns, tapes and similar configurations formed from synthetic resins.

It is a primary object of this invention to provide improved method and apparatus for drawing fibers, monofilaments, etc., the method and apparatus giving rise to drawn fibers having improved physical characteristics, in particular tensile strength. It is another object of this invention to provide method and apparatus of the character described which may effect such drawing at a speed equivalent to that at which the fibers are melt spun or extruded, thus making an intermediate storage of the fibers unnecessary. It is yet another object of this invention to provide method and apparatus of the character described which provide for the ready attainment of variable draw ratios, whether continuous or discontinuous, which make possible the periodic variation in physical characteristics along the length of the fibers and which make possible the incorporation of other physical and chemical treatments at various points during the gradual drawing process. It is yet a further object of this invention to provide method and apparatus of the character described which make possible the gradual acceleration of moving fibers between undrawn and drawn speeds so as to reduce both the fibers tension and the power required to accelerate fibers during drawing.

Another object of this invention is to provide a method and apparatus for preparing textured fibers having high crimp retentivity and high retractive force. A further object is to provide a method and apparatus for drawing monofilaments with improved cross-sectional uniformity and also without causing cross-sectional distortion or asymmetry. Other objects of the invention will in part be obvious and will in part be apparent hereinafter.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

SUMMARY OF THE INVENTION

According to the present invention, the fiber, yarn, tape or other similarly configured elongated member is caused to follow a multiplicity of turns between spaced-apart bodies to initially engage the surfaces of the bodies under a predetermined tension and at an angle of 90° with the body axes. At least one of the bodies is an axially symmetrical body of rotation with its drawing surface being defined by a continuously increasing radius. The drawing surface of the body of bodies is of a character which makes an essentially nonsliding frictional contact with the fiber and the angle of wrap of the fiber around the bodies normally approximately 180°, but may lie between 170° and 300°. In its engagement with the drawing surface of the body or bodies, the fiber experiences only incremental drawing steps through its incremental acceleration brought about through the frictional contact with the drawing surface. Such acceleration of the fiber in any given stage should not be greater than 10% of the total acceleration it experiences. The tension of the fiber just prior to initial engagement with the drawing surface may be periodically varied, the number of draw stages may be continuously varied, and physical and/or chemical treatment may be combined with the drawing.

In the prior art, U.S. Pat. No. 2,788,542 suggests the possible one of two canted conical rolls within a zone designed to effect chemical treatment of a fiber to permit the fiber to shrink or to be concurrently stretched during the treatment. U.S. Pat. No. 1,902,224 shows the use of a rotating capstan on which are mounted a series of rollers which may be conical in configuration for effecting the continuous pulling of a strand around which a braided cover is being applied.

Further to the prior art noted above, it is illuminating to contrast the present invention with the disclosures of British Pat. Specifications Nos. 1,279,535 and 1,305,758. The former specification appears to disclose strand storing apparatus having a pair of circumferentially-grooved rolls disposed side-by-side with parallel roll axes, with the grooves in a staggered offset, and with the rolls in very close proximity. By way of contrast, the present invention employs rolls arranged with skewed axes, and does not require the aforesaid staggered-groove arrangement or close roll-to-roll proximity. In contrast to the latter British Specification noted above, which discloses an arrangement in which strand-storing rolls are driven by the advancement of the strand and are coupled together for rotation at a fixed speed ratio, the present invention is free of these supposed requirements. With these and other differences in structure, the present invention attains results in performance different from those of both British specifications.

In the practice of this invention the spaced-apart bodies may both have drawing surfaces defined by a continuously increasing radius; or one of the bodies may be a passive body serving as a guide only and configured to have a smooth surface throughout it length of fiber engagement such as a ceramic pin or a plurality of coaxial juxtaposed guide surfaces. The latter arrangement is preferred. If both of two spaced-apart bodies have drawing surfaces, one or both may be driven.

Further, each drawing body has a surface topography that enhances the adoption, by the fiber, of a natural helical wrap about that body. This natural path of fiber wrap is characterized by the highly desirable minimum "wandering" of the fiber along the drawing surface. It results from the drawing surface supporting the fiber in a manner that subjects the fiber to minimal force axial of the body.-The drawing surface topography which the invention provides to attain the foregoing operation and result is termed a microterraced surface.

The longitudinal axes of the spaced-apart bodies must be canted with respect to each other. Under these circumstances the axes of the bodies constitute two skew straight lines in space. The common perpendicular, which is the shortest distance between these lines is preferably located beyond the maximum radius end of the body with the drawing surface, i.e. between the extensions of the axes of the spaced-apart bodies in the axial direction of fiber advance. Considering that the two skew straight axes lie in two, and only two parallel planes, the angle of cant is the angle between the first axis or an extension thereof and the projection of the second axis on that parallel plane which contains the first axis and the extension thereof. Preferably, the angle of cant ranges between 1° and 40°.

With such an arrangement in accordance with the invention the rotating body or bodies with a drawing surface can be driven at such a speed that the minimum initial surface speed of the drawing surface may be of the same order of magnitude as the rate of extrusion or of melt spinning. This means that the drawing of the fibers in accordance with the invention may be an integral part of the fiber formation process. Thus, the stretched fiber leaves the drawing stage at a maximum surface speed while it enters the drawing stage at a speed which corresponds to the speed of extrusion or spinning. Since all of the drawing of the fiber in the practice of this invention is in fact divided into small, parallel, simultaneous, incremental steps, the tension required to accomplish the drawing is less than that required when the drawing is done by one or two steps as in the case of "impulse drawing". Generally, no stage in the drawing of fibers in the practice of this invention accomplishes more than 10% of the total drawing done.

BRIEF DESCRIPTION OF DRAWINGS

For a fuller understanding of the nature and objects of the invention, reference should be had to the following detailed description taken in connection with the accompanying drawing in which:

FIG. 1 is a schematic front elevation showing a drawing apparatus in accordance with one embodiment of the present invention;

FIG. 2 is a side elevation of a pair of mutually canted drawing cones in accordance with the present invention viewed to show the angle of axial cant;

FIG. 3 is a front elevation of the drawing cones shown in FIG. 2;

FIG. 4 is a side elevation of a cone and spaced-apart cylindrical body for use in carrying out the method in accordance with the present invention;

FIG. 5 is a front elevation of a view shown in FIG. 4;

FIG. 6 is a perspective view of a variant of the arrangement shown in FIGS. 4 and 5;

FIG. 7 is a schematic view of a serialy cascaded drawing apparatus in accordance with the present invention;

Figure 8:
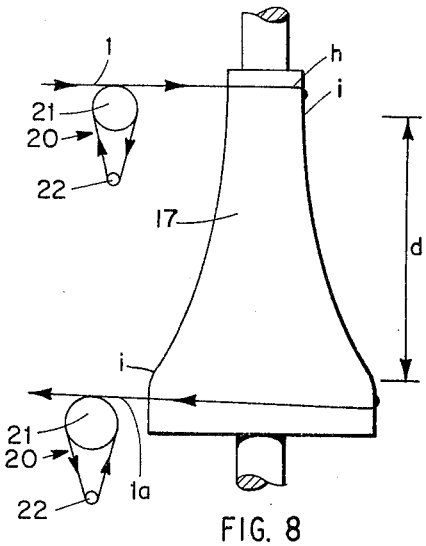
FIGS. 8-10 illustrate forms of the drawing body other than conical which may be used in the practice of this invention.

As seen generally in FIG. 1 of the drawings, the fiber 1 which is to be drawn passes through predrawing tension controlling means, e.g. a pair of rollers 2 adapted to adjust the tension of the fiber just prior to its engagement with the drawing surface, and then through a guide 3 before contacting the surface of a first body 4. The fiber is caused to pass around and contact the surfaces of a pair of frusto-conical bodies 4 and 5 so as to follow a helical path in the direction of increasing radius encompassing both conical bodies. In other words, the turns of the helix steadily increases in linear speed. Each helical turn of the fiber passes around a portion of the surface of each of the frusto-conical bodies. The arrangement is such that each helical turn passes successively in contact with successive portions of the two respective bodies, these portions being of successively increasing radius. The material of which the surfaces of the frusto-conical bodies 3 and 4 are constructed in such that the fibers pass in nonsliding frictional contact with these bodies. As a consequence of passing successively from smaller to larger diameter portions of the conical bodies, the fiber also passes successively from portions of lower to portions of higher surface speeds. In consequence, the fiber is elongated at each passage between the surfaces by an amount equal to the ratio of the surface diameter just left (the departing diameter) to the diameter of the surface portion now contacted (the receiving diameter). After disengagement with the drawing surface, the drawn fiber 1a passes through a pair of guide pins 6 and then through post-drawing tensioning means, e.g. a pair of rollers 7.

Now the force required to draw the fiber increases both with the speed and extent of drawing so that both are in effect limited by the maximum tension which the fiber can stand without breaking. With helical drawing of the kind just described the drawing is broken up into a number of substages or increments equal to the number of turns if only one of the spaced-bodies has a drawing surface, or equal to double the number of turns if both of the bodies have drawing surfaces. Thus, with this helical drawing the draw speed can be increased (for a given draw ratio) by a factor which approaches the number of draw stages. Alternatively, if the draw speed is not increased the power required to draw to a given draw ratio is reduced by using the helical, incremental drawing technique rather than using conventional drawing.

The details of operation are illustrated in FIGS. 2–6, FIGS. 2 and 3 showing the use of two drawing bodies and FIGS. 4–6 showing the use of one drawing and one guiding body. In FIGS. 2 and 3 the two drawing bodies 8 and 9 are of a frusto-conical configuration. The axis $a_8$ of the body 8 is aligned vertically while the axis of $a_9$ of body 9 if canted at an angle of cant $\theta$ which preferably ranges between about 1° and about 40°. The common perpendicular $p$ represents the shortest distance between $a_8$ and $a_9$. Only that part of the surface of bodies 8 and 9 which exhibits an increasing radius $r$ forms the drawing surface, the length of which is indicated by "$d$" in FIG. 3. The drawing bodies preferably have nondrawing contacting surfaces at their upper and/or lower end. These nondrawing contacting surfaces, hereinafter referred to as "holding surfaces" are generally cylindrical in configuration. The holding surfaces of the bodies in FIG. 3 (as well as in some subsequent drawings) is designated "$h$". When such holding surfaces are used, then the draw ratio to which the fiber is subjected is substantially equal to the ratio of the diameters of the larger to the smaller of these surfaces. The drawing bodies may be oriented with the initial contacting, smaller radius surface at the top or bottom, or horizontally, or in any other desired position.

As illustrated in FIG. 3, the intersection $i$ between the holding surface $h$ and drawing surface defined within limit $d$ is preferably smooth, that is the intersection joining these surfaces is radiused so as to provide a smooth and gradual transition from the holding surface to the drawing surface and/or from the drawing surface to the holding surface. This type of surface intersection has some operational advantage, particularly if it is necessary to strip off a tangled filament or yarn. It will be understood that all of the embodiments of the bodies with drawing surfaces shown in the drawings may have radiused intersections at the holding and drawing surfaces.

The surface of the drawing body, e.g. of cones 8 and 9, must be of a character to make a nonslip frictional contact with the fiber, yarn or tape being drawn. This surface character may be inherent in the material used to form the body surface (e.g. a ceramic) or it may be imparted to the surface. Although both bodies 8 and 9 may be driven at the same angular speed, one of the bodies, for example the vertically disposed body 8, may be driven while the other body 9 freely rotates about its canted axis. During any one operation the bodies are mounted on fixed axes, the angle of cant of which may be adjusted from run to run. As will be discussed below in connection with FIGS. 15 and 16, the angle of cant may be varied to vary the number of draw stages to effect a given draw ratio.

The fiber engages the body surface at an angle of 90° to the body axis. For drawing to occur between one body and the next, an appreciable tension rise must occur as the fiber travels over the drawing surface. This tension rise tends to cause the fiber to slip on the drawing surface. The tendency of the fiber or yarn to slip on the drawing surface is, however, prevented by providing an angle of wrap on the rotating draw body of approximately 180° or greater. This angle of wrap depends upon the relative diameters of the two spaced-apart bodies and upon the manner in which the fibers are wrapped around the bodies. Normally, the fiber will be wrapped around both bodies in the same direction following a pattern which has circular ends and flattened sides. However, it is also possible to wrap the fiber in a figure-eight pattern in which case the spaced-apart bodies, if both are rotatably mounted, will rotate in opposite directions. Such a figure-eight wrapping pattern increases the angle of wrap beyond 180°, e.g. up to 300°.

The difference in tension that can be sustained without slip over the body is determined by the classical "pulley formula" written as $$\frac{T_d}{T_i} = e^{\mu \Phi}$$

where $T_i$ and $T_d$ are tensions of the incoming and departing fiber, $e$ is the base of natural logarithms, $\mu$ is the coefficient of friction and $\phi$ is the angle of wrap. The equation shows that the difference between the entering and departing fiber tension is exponentially related to the angle of wrap. This in turn means that the tension difference that can be sustained without slip on a spindle increases at an exceedingly rapid rate with the angle of wrap.

The configuration of the drawing surface, i.e. the rate of increase of radius, should be such that the acceleration experienced by the fiber drawn over it in any one stage is no greater than 10% of the total acceleration experienced by the fiber. This, of course, means that no single stage should effect any more than 10% of the total draw. If both of the spaced-apart bodies have drawing surfaces as in FIGS. 2 and 3, then the rates of increase in the two radii must be considered, and each turn of the helical fiber loop constitutes two draw stages. In general the number of drawing stages will range between ten and about one hundred.

In accordance with a further feature of the invention, each tapered draw body 8, 9 of FIGS. 2 and 3 has a microterraced surface. This surface, illustrated in FIGS. 19 and 20, minimizes self-induced or spontaneous "wandering" or shifting of the fiber along the drawing surface. This is in contrast to an imposed shift of the fiber along the surface as results, for example, by changing the fiber tension or the disposition of the draw bodies. More particularly, a fiber will tend naturally to follow a helical path in traversing between canted rolls such as the FIGS. 2 and 3 draw bodies 8 and 9. The helical path which the fiber form upon each draw body when subjected to only tension and the reactive force which the draw body surface exerts on it is referred to as a "natural helix". This natural path generally is different from the path which the fiber follows when subjected to constraining grooves or other guides. The pitch, or distance between consecutive turns, of the natural helix of the fiber is geometrically determined and, as is known, is a function of the angle of cant between the axes of the bodies, as well as of the diameters of the bodies and the spacing between them.

Figure 21:
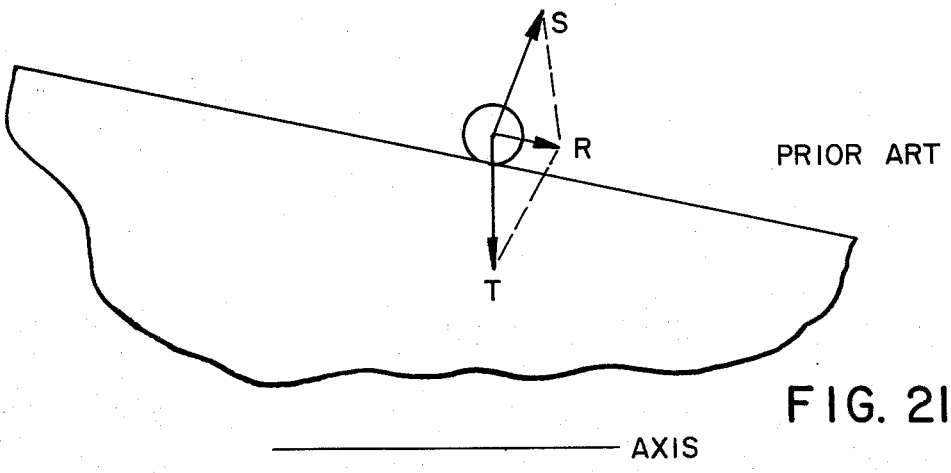
FIG. 21 is an enlarged fragmentary axial cross-sectional view of a draw body with a continuously-tapered prior art surface and diagrams the forces tending to move the fiber axially of the body in the direction of lesser diameter.

When a fiber forms a helical path on a smoothly surfaced conical or tapered draw body, a helix destabilizing force arises because the fiber tensile force acts at an angle to the reactive force exerted by the surface of the body. This is shown in FIG. 21, where the fiber tensile force, T, acts perpendicular to the axis of the fiber-receiving draw body. The surface reactive force, S, however acts perpendicular to that draw body surface. These forces S and T are not in line with each other and hence produce a resultant force, R, which acts along the body surface in the direction toward the smaller diameter. The resultant force hence tends to destabilize the helix by displacing the fiber from the natural helix. Under sufficiently high fiber tension, the destabilizing force can collapse the helix toward the smaller end of the draw body.

Figure 19:
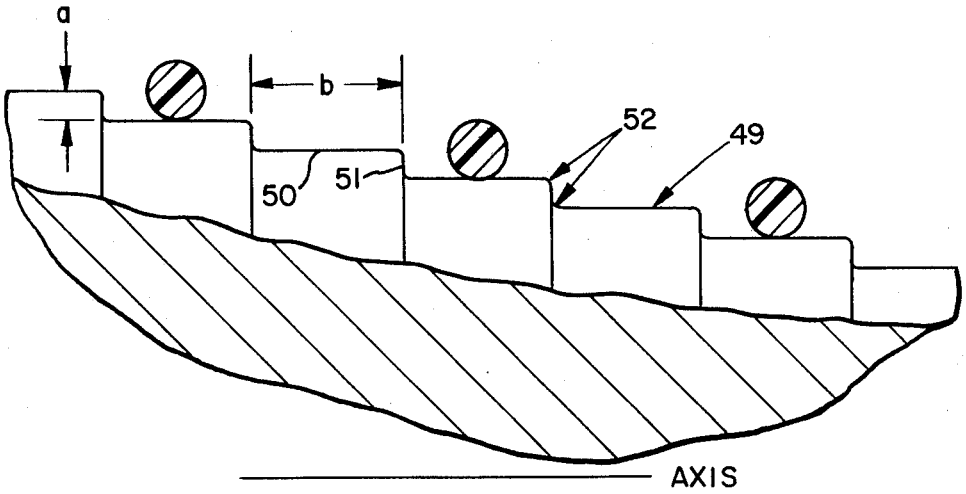
FIGS. 19 and 20 are enlarged fragmentary axial cross-sectional views of a tapered drawing body and showing a microterraced surface for stabilizing the fiber on the draw body in accordance with the invention.
Figure 20:
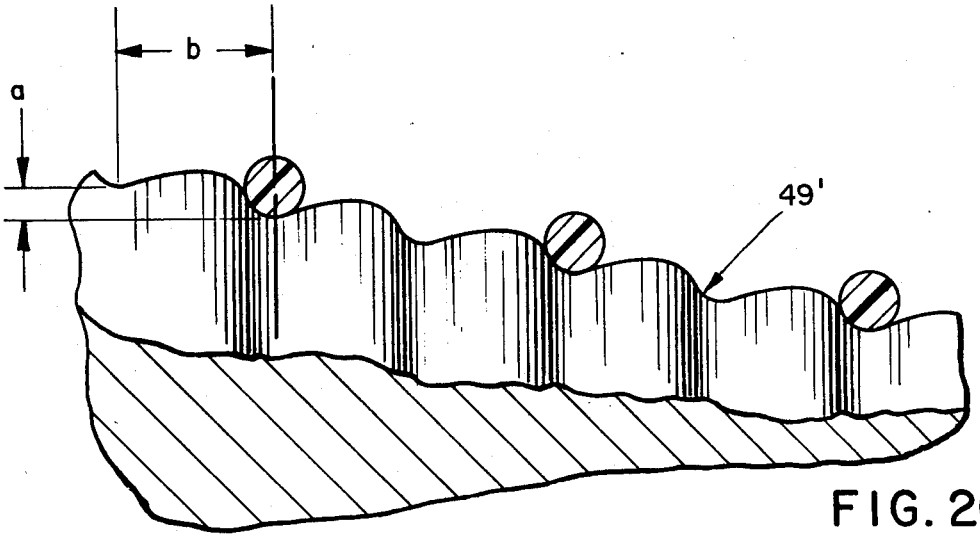

The microterraced surface shown in FIGS. 19 and 20 supports the fiber, throughout its contact with the body, with a surface portion that is substantially parallel to the body axis so that the surface reactive force is essentially oppositely in line with the fiber tension. Hence, there is a negligible destabilizing force, because the vector resultant of the two forces S and T has minimal axial component.

With further reference to FIG. 19, the microterraced surface 49 follows the desired taper or frusto-conical contour, with an alternate succession of fiber-bearing terraces 50 and risers 51. The illustrated terraces are circumferential, generally axially extending and hence facing radially outward, surface portions, i.e. substantially cylindrical bands generally parallel to the axis of the draw body. The illustrated risers 51 are circumferential, radially extending, surface portions. The intersections between these portions are radiused, as at 52. This is a general purpose microterraced surface in that it can be used for drawing both multifilament and monofilament fibers. Note that the terraces and the risers of the microterraced surface do not spiral along the drawing surface. Rather, each such surface portion is a discrete circumferential band.

The ratio of the radial height of each microterraced riser 51 to the axial width of each microterrace 50, i.e. the ratio of the dimension (a) to dimension (b) in FIG. 19, is equal to the slope or tangent of the drawing surface relative to the axis of the drawing body. These dimensions and their ratio can vary along the length of the drawing surface. Further, the width (b) is sufficiently large to support the fiber, but yet small enough so that consecutive turns of the fiber are on different terraces. The dimension (b) accordingly is no less than the diameter of the undrawn fiber and is typically not less than about one and one-half times the width of the fiber or fiber bundle being drawn. When drawing a single monofilament of circular cross section, this dimension corresponds to one and one-half times the diameter of the undrawn filament. For drawing multifilament bundles, this width (b) corresponds to about one and one-half times the undrawn diameter of each filament times the number of filaments in the bundle. The height (a) corresponds to the value determined by the tangent or slope of the draw body surface with respect to its axis, for a specified width (b). The fiber can move across the terraces from larger diameters to smaller ones without resistance from the terraces, and in most instances the height (a) does not restrict relatively facile movement of the fiber in the direction of larger diameter, as the fiber assumes the natural helix path. The height (a) may be of the same order of magnitude as the undrawn fiber diameter. Generally, the height (a) is between 0.3 and 0.0005 inch with a preferred range for most applications being between 0.05 and 0.001 inch.

By way of illustrative example, in one practice of the invention, a monofilament having an undrawn diameter of 0.020 inch was drawn to 0.009 inch in successive drawing increments on tapered draw bodies having the microterraced surface of FIG. 19 with a uniform terrace width (b) of 0.030 inch and a uniform riser height of 0.005 inch.

As usually practiced, the fiber being drawn does not run on consecutive microterraces of the same draw body but only on those microterraces corresponding to the pitch of the natural helix. Hence in operation there usually are one or more unoccupied microterraces between each occupied microterrace, as shown in FIG. 19 where successive turns of the fiber are spaced apart by an empty microterrace. To provide this operation, a draw body has, at the minimum, as many microterraces as there are turns of the fiber about that body; and in general practice has more than this minimal number of terrace portions.

FIG. 20 shows another configuration of the microterraced surface which the invention provides. The surface 49' is dimensioned with terraces and risers as in FIG. 19, but the terraces are concavely rounded to support the fiber with a conforming rounded surface. This construction minimizes deformation of a rounded fiber as might result from drawing it on a flat surface. Hence the FIG. 20 surface 49′ is particularly suited for drawing monofilaments. The trough or concavity of the microterrace has a curvature generally equal to that of the monofilament so that, as stated, heavy denier monofilaments can be drawn on this surface with minimal distortion to their circular cross-sectional geometry.

The microterraced surface which FIGS. 19 and 20 illustrate contributes significantly to successful incremental draw processing in accordance with the invention. As FIGS. 19 and 20 show, the microcontours of the surface eliminate the helix destabilizing resultant force (FIG. 21) and instead carry the yarn so that the surface reactive forces are anti-parallel to the tensile forces. The terraced microcontours differ from a conventional circumferential groove or guide in that they introduce no significant axial constraint, and no sliding or abrasive contact, to the fiber. As a result, the fiber is essentially free to move axially along the draw body axis to locations on the body surface consistent with the natural helix. One result of the microterraced contour is that if the cant angle of the draw body axes is changed, the fiber will move - on its own - to a new helix consistent with the new cant angle of the axes.

With further reference to FIGS. 2 and 3, the cone angle or other angle of taper of each frusto-conical or otherwise tapered drawing body, as the bodies 8 and 9 in FIGS. 2 and 3, with a microterraced surface as described is between about 10° and 90°, and preferably between about 15° and 30°. Generally for reasons of compactness, the optimal conical or other taper angle for the drawing surface is the largest angle which will stably support the particular fiber in a natural helix path, given the particular fiber tension and microteer-raced surface. The provision of a microterraced surface facilitates the use of a relatively large cone or other taper angle. Such large internal draw body angles have an important advantage in that they permit the achievement of large total draws, i.e. large ratios between the diameters of the large and small ends of the rotating draw body, within a relatively short axial length.

All embodiments of the invention set forth herein preferably are practiced with the microterraced draw body surface. This is particularly so for the practice of the invention shown in FIGS. 1–12, for the embodiments of FIGS. 13–18 in particular employ improvements that can be practiced to advantage with prior art drawing surfaces.

In the embodiment shown in FIGS. 4 and 5, a canted guiding body in the form of a cylindrical pin 10 replaces one of the drawing bodies. In this embodiment the conical drawing body 8 is driven by a motor 11 through a toothed belt 12 while the cylindrical pin 10 is either fixedly mounted or adapted for free rotation in a suitable support such as bearing 13. In these embodiments the fiber 1 slides over the pin 10 and arrangements must be made to reduce frictional wear on the pin, as for example by constructing the pin with a hard smooth ceramic surface and by the application of suitable finishes to the fiber surface. The pin itself need not be axially symmetrical but may have any cross sectional shape which presents a smooth traverse path to the yarn.

FIG. 6 illustrates the replacement of the cylindrical pin 10 by a plurality of stacked co-axial idler guides 14. The provision of such guides 14 considerably reduces or avoids altogether the frictional wear of the fiber and surfaces.

In the embodiments schematically illustrated in FIG. 7 of the drawings two separate but continuous drawing steps are shown in a cascade array wherein the fiber is successively elongated around two pairs 15 and 16 of mutually canted conical bodies. It is within the scope of this invention to employ any number of such separate, continuous steps in the drawing, each step affording the possibility of effecting distinct and separate physical and chemical treatments if desired.

Figure 9:
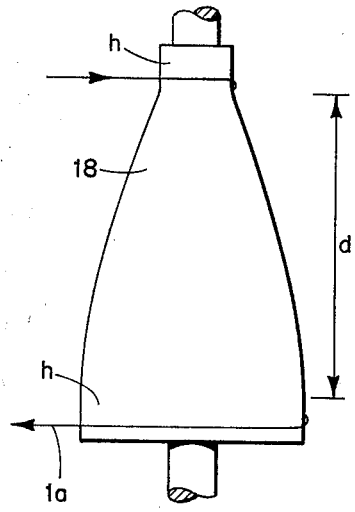
Figure 10:
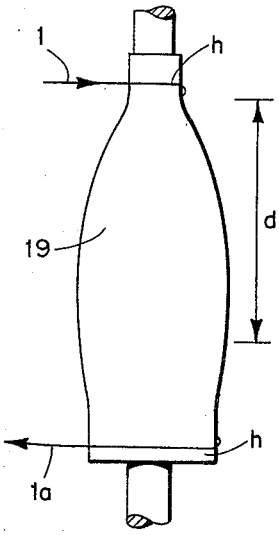

FIGS. 8–10 illustrate three of many different modifications of the drawing body for performing incremental drawing and with a microterraced surface. In the case of drawing body 17 of FIG. 8 having a concave conical cross section and body 18 of FIG. 9 having a convex conical cross section, the drawing surfaces extend the length *d* of the bodies and make up the larger portion of the overall surface since the radii continue to increase from the intersection of the smaller-diameter holding surface with the drawing surface to the intersection of the drawing surface with the larger-diameter holding surface. In the configuration of FIG. 10, the actual drawing surface within limit *d* extends only over a portion of the overall body surface of body 19. Such an arrangement as shown in FIG. 10 may be desirable to compensate for fiber shrinking due to a physical or chemical treatment that may be applied during the later incremental stages of the drawing process or immediately after the draw stages.

FIG. 8 also illustrates another embodiment of a known tension control means 20, namely two separated rolls 21 and 22 around which the fiber or yarn is wound as shown by the arrows. If desired, roll 21 may be heated, and tension is controlled by the surface speed of the two different-diameter rolls relative to the surface speed of the point of contact of the incoming fiber on the draw surface.

Figure 11:
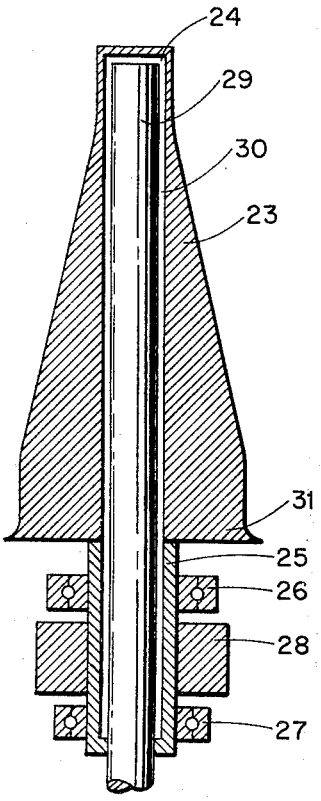
FIG. 11 is a cross section of a conical drawing body having internal heating means.

FIG. 11 illustrates a conically configured drawing body modified to achieve heating of the fiber during drawing through the use of internal heating means. The conical drawing body 23 has an axial passage 24 closed at the top and is affixed to a shaft 25 which is supported and aligned within bearings 26 and 27 and driven by a gear 28 which in turn is driven by a motor (not shown). A stationary heating element 29 extends up through the axial passage 24. Between the heating element 29 and the walls of passage 24 there is defined a fluid passage 30 suitable for containing a fluid capable of serving the role of lubricant and, if desired, also of a heat transfer medium. The heating element 29 may take the form of an electrical insertion heater or of a tubing suitable for the circulation of a heating fluid (gas or liquid). The heating element may be designed to impose a controlled gradient of temperature on the draw body. Preferentially the temperature of the large diameter portion of the draw body is made higher than the small diameter portion to counter, with increased heat, the increase in tension required for successive incremental drawings of the fiber. A small web 31 may be formed on the end of the holding surface to prevent the fiber from running off the holding surface onto the drive shaft.

Figure 12:
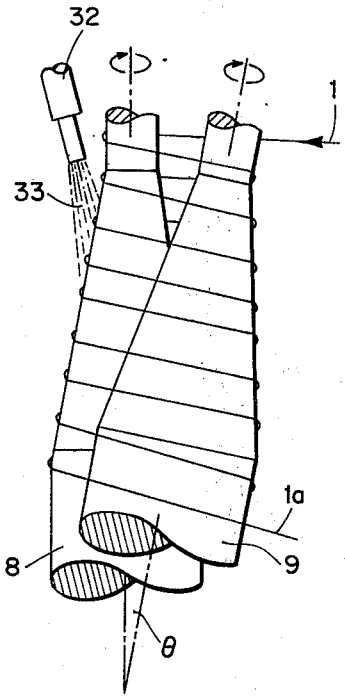
FIG. 12 illustrates one means for applying a liquid treating agent to the fiber during drawing.

FIG. 12 illustrates one embodiment of liquid treating means which comprises a nozzle 21 positioned to spray a liquid 33 onto fiber drawing body 8. As the liquid travels over the drawing surface, it is absorbed by the fiber being drawn. It is within the scope of this invention to introduce liquid onto one or more of the drawing or guiding bodies or between the bodies. It is also, of course, possible to surround one or more drawing or guiding bodies with means for defining a treating zone around the bodies and to introduce liquid or gas into the zone, or to control the temperature within the zone. By extending the time the fiber spends in the drawing zone, the method of this invention also makes possible the achievement of extended chemical and thermal treatments during the drawing step.

Figure 13:
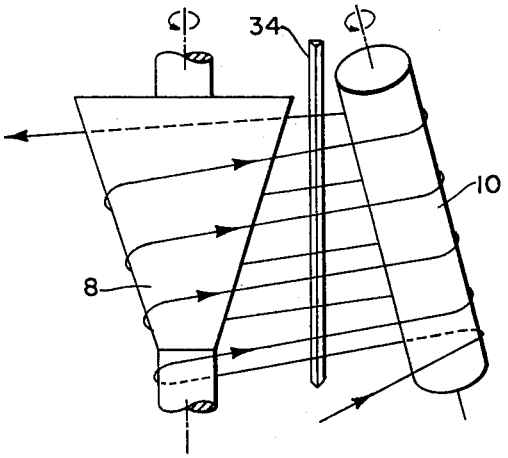
FIG. 13 illustrates one means for changing the physical character of the fiber during drawing.

FIG. 13 illustrates the contacting of the fiber with a heated knife edge 34 to impart an asymmetric strain or deformation on the fiber during drawing. This is exemplary of one way in which the physical properties of the fiber may be altered during drawing.

Using the method and apparatus of this invention it is possible to vary the draw ratio. This may be done rapidly and periodically during the drawing of a fiber to impart a high-frequency periodicity to the extent of drawing experienced by the fiber or it may be done from run to run. Thus the draw ratio may be varied from one type of fiber to another type by essentially the same mechanism. One embodiment of a mechanism for regulating the draw ratio using a drawing body without holding surfaces is shown in FIG. 14.

Figure 14:
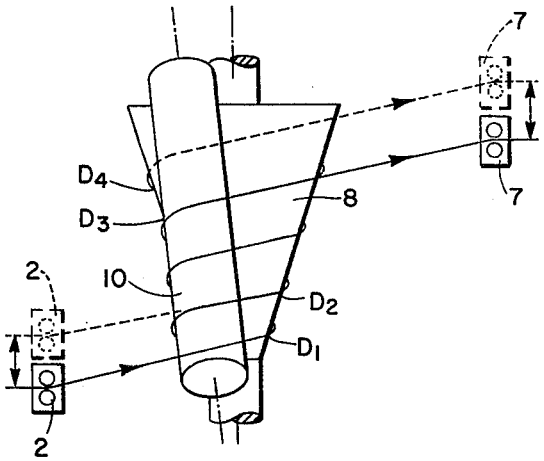
FIG. 14 illustrates one embodiment of means to change the draw ratio accomplished by any one drawing surface.

In the apparatus of FIG. 14, the predrawing tensioning control means 2 and postdrawing tensioning means 7 are moved up and down. If, for example, the two tensioning means 2 and 7 are in the positions shown by the solid lines, the draw ratio achieved is the ratio of the diameter of the cone at $D_3$ to the diameter of the cone at $D_1$; while if the two tensioning means are in the position shown by the dotted lines, the draw ratio achieved is the ratio of the diameter of the cone at $D_4$ to the diameter of the cone at $D_2$. As the incoming guide or tensioning means 2 is raised or lowered, the helix spontaneously shifts in the same direction. Thus moving the point of fiber engagement is all that is needed to vary the draw ratio.

Figure 15:
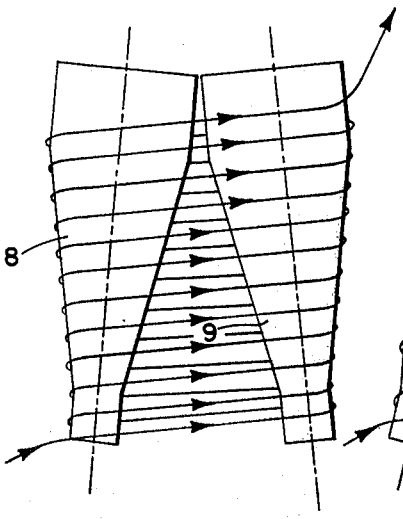
FIGS. 15 and 16 illustrate the manner by which the angle of longitudinal axes cant changes the number of draw stages accomplished by a set of drawing surfaces.
Figure 16:
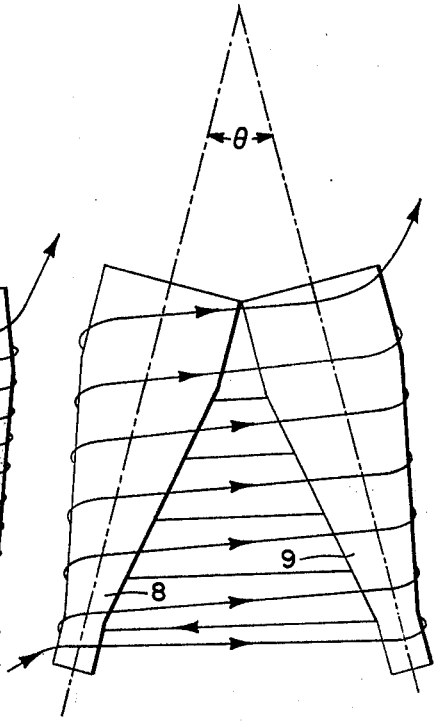

FIGS. 15 and 16 illustrate how the number of draw stages depends upon the angle of cant between the two longitudinal axes of two drawing bodies 8 and 9. This angle of cant may be adjusted by suitable mechanical means. A draw stage is defined as a passage between surfaces. If, as in the case of FIGS. 15 and 16, both bodies are drawing bodies, then one fiber loop around them constitutes two draw stages. The draw ratio is in turn the ratio of the drawing body diameter at the final point of fiber departure to the diameter at the initial point of fiber entry. Thus for any given drawing body or set of drawing bodies used along the entire drawing surface, the draw ratio remains constant, but the number of stages used to achieve this draw ratio may be varied. In the case of FIG. 15 where the angle of cant $\theta$ is smaller than in FIG. 16, the pitch of the wound fiber helix is smaller and the number of draw stages is greater; while in FIG. 16 the angle of cant $\theta$ is larger, the pitch of the wound fiber helix is greater and the number of draw stages is smaller. As an example of the advantages to be gained by being able to vary the number of draw stages, it may be pointed out that this makes it possible to control the residence time of a fiber being drawn in a chemical or physical treating atmosphere.

Means may also be incorporated with one, or both, of the draw bodies to vary the angle of axial cant in a periodic fashion. If for example such means are affixed to body 9 in FIG. 16 and the cant angle $\theta$ is decreased from the maximum angle shown in FIG. 16, then the helix pitch will decrease; whereas the number of helix turns will remain unchanged. Because the point of initial fiber to surface engagement remains substantially unchanged, the helix will partially collapse so that the point of fiber departure from the draw surface occurs at a smaller diameter. Consequently, the fiber experiences a smaller draw at the smaller cant angle and a larger draw at the larger cant angle. The draw ratio thus achieved, by alternately decreasing and enlarging the cant angle, has a long period of variation. A short periodicity variation in draw ratio is accomplished by means shown in FIGS. 17 and 18.

Figure 17:
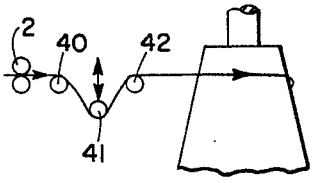
FIGS. 17 and 18 illustrate means to periodically change the tension on the fiber just prior to initial engagement with the drawing surface to achieve bulking.
Figure 18:
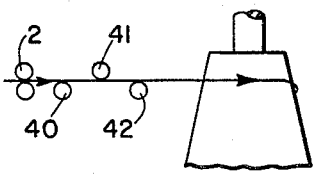

The predrawing tension of the fiber may also be periodically varied to impart a periodicity of degree of drawing and orientation to the fiber. FIGS. 17 and 18 illustrate one means for periodically increasing the predrawing tension through the use of three guide pins 40, 41 and 42. By rapidly moving or vibrating the central guide pin up and down the tension is varied periodically. The result is a drawn fiber which can exhibit either periodic differential shrinkage or differential dye uptake. The former characteristic is useful in producing high-bulk fabric whereas the latter characteristic can be used to produce interesting decorative effects. This periodic variation in draw ratio achieved because an increase in tension (guide pin 41 in the position of FIG. 17) retards the initial point of nonslip engagement of the fiber on the conical drawing body while a decrease in the tension advances the initial point of nonslip engagement. This means that the draw ratio is smaller with lower tension and greater with high tension. The periodic, alternating high and low draw ratios effect the bulking characteristic of the fiber, particularly when in fabrics.

In one specific example of drawing carried out in accordance with the present invention wherein one pair of drawing bodies, each having a microterraced drawing surface, was involved, undrawn, 34 filament, polyethylene terephthalate yarn emerged from the feed rolls at a speed of 800 yards per minute. Drawing took place around mutually canted frusto-conical bodies whose minimum diameter was 1 cm., maximum diameter 3.85 cms., length 14 cms. and whose common perpendicular between the axes of the bodies was 15 cms. in length and was located 10 cms. beyond the large diameter end of the bodies. The angle of cant between the axes of the two bodies was 15°. The conical surface speed at minimum diameter was 840 yards per minute while the conical surface speed at maximum diameter was 3,234 yards per minute. The horizontally mounted conical body was power driven while the other body was rotatably mounted and was driven by the yarn.

The conical bodies were maintained at a surface temperature of 120°C (by an internal electrical heater element) while the helical path included ten turns. With such an arrangement the speed of the stretched drawn fibers passing between the take-off rolls was 3,202 yards per minute. The final yarn had a drawn denier of 70.

In a second example using the two-stage helical drawing process illustrated schematically in FIG. 7 of the drawings, the fiber to be drawn (3,000 denier consisting of 2,000 filaments) emerged from the feed rolls at a feed speed of 100 yards per minute. Using microterraced conical bodies having minimum diameter 15 cms., maximum diameter 30 cms., overall length 50 cms., and common perpendicular 80 cms. and angle of cant 25°, the surface speed of the first set of cones at minimum diameter was 155 yards per minute and at maximum diameter 210 yards per minute and at the second set of cones at minimum diameter 325.5 yards per minute and at maximum diameter 451 yards per minute. The conical bodies were maintained at a surface temperature of 90° (by surrounding the conical bodies with steam in a steam chest while each helical path included four turns. With such an arrangement the drawn yarn passing through the take-off roll has a speed of 744 yards per minute. The power supply to the draw-cone drive motor is less than one-half that required to accomplish the same drawing in a single stage conventional drawing procedure.

In a third example in which an ultra high draw ratio is achieved the microterraced conical bodies were asymmetrically heated, the temperature at the maximum diameter being 125°C and at minumum diameter being 50°C. The bodies had a minimum diameter of 1 cm., a maximum diameter of 11.5 cms., a length of 50 cms. and an angle of cant of 10.5°. The undrawn fiber (120 filament) emerged from the feed rolls at a speed of 500 yards per minute and had a take-off speed of 5745 yards per minute being 250 denier. The helical path had 30 turns. The drawn yarn had a high birefringence and a very high elastic modulus and breaking strength. It is suitable for tire cord use.

In another example, an undrawn polyester fiber, the drawn denier of which is 22–7, i.e. having a total drawn denier of twenty-two with seven filaments per thread line bundle, was fed to a pair of incremental microterraced draw bodies, each having a contour as shown in FIG. 9, and set up to achieve an overall ultra high draw ratio of 6.2 in thirty incremental draw stages. The draw bodies were heated by means similar to those shown in FIG. 11 to establish a temperature gradient ranging from 50°C at their narrow diameter to 150°C at their maximum diameter. The last four incremental stages of draw were performed at one-fourth the rate of the rate of the initial draw by a corresponding reduction in the slope of the draw bodies in the manner suggested by FIG. 9. The yarn from the draw bodies then passed directly to a conventional false twist texturizing apparatus. The resulting false twist textured yarn had 30% greater crimp retraction force than a sample of yarn subjected to conventional draw twist texture processing.

The incremental draw equipment of the invention can also subject a fiber to alternate incremental drawing and relaxation. For example, where the cylindrical pin 10 of FIG. 5 has a diameter different from that of the surface of the tapered body 8, the fiber 1*a* is subjected to an increase in tension, and a corresponding increment of draw, in passing from the smaller diameter member to the larger, but is then subjected to a decrease in tension, and a corresponding axial relaxation, in passing back to the smaller diameter member. The same operation results with a pair of similarly tapered draw bodies, as in FIGS. 2 and 3, which are axially displaced so that successive passes of the fiber traverse alternately to a larger diameter draw surface and to a smaller diameter surface.

The invention further has advantages when used to effect super drawing of fiber, as described in the article entitled "Super-Drawn Crystalline Polymers, A New Class Of High Strength Fiber" by E. S. Clark and L. S. Scott published in Polymer Reprints, Division of Polymer Chemistry, American Chemical Society, Vol. 15, No. 1, April 1974, at pp. 153–158.

The provision of a microterraced roll body as described hereinabove thus enables the roll body to support a tensioned strand in a natural helix, even when the body has a relatively large taper, e.g. 30° and greater. The microterraced roll body does not require guides or the like to maintain the strand thereon in this configuration. The strand is free of externally-imposed locational constraint in passing between and around the roll bodies. In the natural helix configuration, the pitch of the helical path increases with the diameter of the roll body. Consequently, the microterrace can be constructed with the width dimension (b), or with both the width dimension (b) and the height dimension (a), progressively increasing along the axial length of the body in relation to the increase in the pitch of the fiber helix as the diameter of the roll body increases.

It will thus be seen that the objects set forth above, among those made apparent from the preceding description, are efficiently attained. Although described principally with reference to fibers, the invention is applicable to the drawing of other forms of elongated members such as yarns and tapes, and hence to strands in general. Since certain changes may be made in carrying out the above method and in the constructions set forth without departing from the scope of the invention, it is intended that all matter contained in the above description or shown in the accompanying drawings shall be interpreted as illustrative and not in a limiting sense.

Having described the invention, what is claimed as new and secured by Letters Patent is:

1. In the process of drawing an extruded synthetic resin strand by passing the strand with plural turns between first and second spaced-apart bodies, each of which is elongated about an axis that extends transversely to the turns of the strand thereon and is canted relative to the axis of the other body, and at least the first said body having a rotating outer surface the radius of which changes along the axis thereof so as to be tapered and which engages the strand with frictional contact, the improvement comprising effecting said drawing gradually and at a controlled rate in incremented steps by supporting said strand on said tapered outer surface on discrete first microterrace surface portions, each of which extends circumferentially around the first body and axially thereof and faces radially outward thereon for subjecting the strand thereon to a surface reaction force directed substantially perpendicular to the body axis, and each of which is spaced from adjacent such portions by a second radially-extended microterrace surface portion, and by supporting each such turn with essentially no substantial axially-directed restraint imposed by said first body on the strand, said supporting step further comprising supporting turns of said strand on said first body on different first surface portions.

2. In the process of claim 1, the further improvement comprising the step of periodically shifting at least one point selected from the point at which said strand engages, and the point at which said strand disengages, said tapered surface of said first body.

3. In the process of claim 1, the further improvement comprising the step of passing at least ten turns of said strand around said tapered surface of said first body, each on a different first surface portion, thereby to subject said strand to at least ten incremental drawings.

4. In the process of claim 1, the further improvement wherein said supporting step includes supporting said strand with concavely rounded first surface portions each of which is contoured substantially to conform to the cross-sectional configuration of the strand.

5. In the process of claim 1, the further improvement of maintaining said strand free of externally-imposed locational constraint in passing between and around said bodies.

6. In a process for drawing strands of extruded synthetic resin in a multiplicity of stages by passing the strands with plural turns between first and second spaced-apart and axially-elongated draw bodies which are axially canted relative to one another, the improvement comprising the steps of supporting said strands on at least one of said draw bodies on a rotatably-driven surface of revolution having a microterraced surface which exerts substantially no axial force on said strands and having a diameter which generally increases in the axial direction thereof, and allowing said strands naturally to assume a helical configuration about said spaced-apart bodies with said helix having a pitch which generally varies as a function of the diameter of the rotatable draw body.

7. In a process of defined in claim 6, the further improvement comprising the step of adjusting the angle of cant between the axes of said draw bodies to adjust said helical configuration.

8. In the process of drawing an extruded synthetic resin strand by passing the strand with plural turns between first and second spaced-apart bodies, each of which is elongated about an axis that extends transversely to the turns of the strand thereon and is canted relative to the axis of the other body, and at least the first said body having a rotating outer surface that is a surface of revolution the radius of which changes along the axis thereof so as to be tapered and which engages the strand with frictional contact, the improvement comprising the step of effecting said drawing gradually and in incremented steps by supporting said strand on said tapered outer surface on first surface portions, each of which is a discrete circumferential terrace configured for subjecting the strand thereon to a radially-directed surface reaction force having a minimal axially-directed and helix-destabilizing component, and each of which is spaced from an adjacent such portion by a second radially-extending surface portion forming a riser between adjacent ones of said terraces, and the further step of engaging said strand with essentially no structure on said first body which has sufficient radial extent to impose a substantially axially-directed restraint on the strand.

* * * * *

UNITED STATES PATENT AND TRADEMARK OFFICE

CERTIFICATE OF CORRECTION

PATENT NO. : 3,978,192

DATED : August 31, 1976

INVENTOR(S) : Martin V. Sussman

It is certified that error appears in the above-identified patent and that said Letters Patent are hereby corrected as shown below:

Column 1, line 62, before "melt" change "of" to --or.

Column 2, line 61, change "approximately" to --approximates--.

Column 3, line 7, change "one" to --use--.

Column 3, line 40, change "it" to --its--.

Column 4, line 41, before "view" change "a" to --the--.

Column 5, line 16, change "increases" to --increase--.

Column 5, line 24, change "in" to --is--.

Column 5, line 59, delete "of" after "axis".

Column 7, line 31, change "form" to --forms--.

Column 9, line 39, change "microteer-" to --microter- --.

UNITED STATES PATENT AND TRADEMARK OFFICE

CERTIFICATE OF CORRECTION

PATENT NO. : 3,978,192

DATED : August 31, 1976

INVENTOR(S) : Martin V. Sussman

It is certified that error appears in the above-identified patent and that said Letters Patent are hereby corrected as shown below:

Column 10, line 67, "21" should be --32--.

Column 11, line 46, after "between" insert --drawing--.

Column 13, line 20, change "minumum" to --minimum--.

Column 15, line 27, change "of" to --as--.

Signed and Sealed this

*Thirty-first* Day of *January 1978*

[SEAL]

*Attest:*

RUTH C. MASON
*Attesting Officer*

LUTRELLE F. PARKER
*Acting Commissioner of Patents and Trademarks*